US011814960B2

(12) United States Patent
Voloshchuk

(10) Patent No.: US 11,814,960 B2
(45) Date of Patent: Nov. 14, 2023

(54) ROTARY ENGINE

(71) Applicant: Mykola Voloshchuk, Novodnistrovsk (UA)

(72) Inventor: Mykola Voloshchuk, Novodnistrovsk (UA)

( * ) Notice: Subject to any disclaimer, the term of this patent is extended or adjusted under 35 U.S.C. 154(b) by 0 days.

(21) Appl. No.: 17/910,786

(22) PCT Filed: Mar. 9, 2021

(86) PCT No.: PCT/IB2021/051935
§ 371 (c)(1),
(2) Date: Sep. 9, 2022

(87) PCT Pub. No.: WO2021/181256
PCT Pub. Date: Sep. 16, 2021

(65) Prior Publication Data

US 2023/0111792 A1 Apr. 13, 2023

(30) Foreign Application Priority Data

Mar. 9, 2020 (EP) ..... 20161928

(51) Int. Cl.
*F01B 13/06* (2006.01)

(52) U.S. Cl.
CPC ..... *F01B 13/061* (2013.01)

(58) Field of Classification Search
CPC ..... F01B 13/045; F01B 13/061; F01B 1/0603
See application file for complete search history.

(56) References Cited

U.S. PATENT DOCUMENTS 3,920,390 A 11/1975 Petersen et al.
4,421,073 A * 12/1983 Arregui ..... F01B 13/045 123/44 D (Continued)

FOREIGN PATENT DOCUMENTS

DE 3730558 A1 3/1989
RU 2088762 C1 8/1997

OTHER PUBLICATIONS

European Application No. EP20161928 Extended Search Report and Written Opinion dated Sep. 9, 2020.

(Continued)

*Primary Examiner* — Abiy Teka
(74) *Attorney, Agent, or Firm* — FisherBroyles, LLP; Jeremy P. Sanders

(57) ABSTRACT

The present invention relates to a rotary engine comprising a stator, a first rotor rotatably mounted on the stator about a rotational axis of the first rotor, and a second rotor rotatably mounted on the stator about a rotational axis of the second rotor parallel to the rotational axis of the first rotor such that the second rotor is eccentrically mounted to and surrounding the first rotor, wherein the first rotor comprises a first cylinder with a piston chamber limited by a translationally displaceable first piston with a first rod fixed to an outer side of the second rotor on an end of the first rod outwardly projecting from the first cylinder towards the outer side of the second rotor and fixed to the first piston on the other end of the first rod, wherein the first rotor further comprises at least one second cylinder, each of the at least one second cylinder comprising a piston chamber limited by a translationally displaceable second piston with a second rod coupled to an outer side of the second rotor on an end of the corresponding second rod outwardly projecting from the respective second cylinder towards the outer side of the second rotor and fixed to the corresponding second piston on (Continued)

the other end of the corresponding second rod, and wherein the end of each second rod coupled to the outer side of the second rotor is supported such that the end is rotationally displaceable along a limited curved guide path within the second rotor.

15 Claims, 10 Drawing Sheets

(56) References Cited

U.S. PATENT DOCUMENTS

| | | | | |
|---|---|---|---|---|
| 5,967,102 | A * | 10/1999 | Huang | F01B 13/045 123/44 D |
| 9,889,380 | B1 | 2/2018 | Wakeford et al. | |
| 2007/0062469 | A1* | 3/2007 | Yakhnis | F02B 57/06 123/44 C |
| 2016/0194959 | A1* | 7/2016 | Pekrul | F01C 19/06 418/146 |

OTHER PUBLICATIONS

International Application No. PCT/IB2021/051935 International Search Report and Written Opinion dated Mar. 9, 2021.

* cited by examiner

ROTARY ENGINE

FIELD OF THE INVENTION

The present invention relates to steam engines, pneumatic engines, pumps and compressors, in particular to rotary engines.

BACKGROUND OF THE INVENTION

Rotary engines are well known alternatives to reciprocating piston machines. A direct rotary movement is generated in rotary engines without requiring a crank mechanism. A major disadvantage of engines based on a crank mechanism is that the overall efficiency of the engine is significantly reduced because of converting a reciprocating motion into a rotational motion. The relatively low efficiency is also caused by the fact that the bearings used in crank drives are often designed as plain bearings on which significantly higher frictional forces act than on roller bearings. Also a disadvantage of an engine with a crank mechanism is a large mechanical friction loss due to the action of powerful lateral forces that press the piston against the walls of the cylinders.

US 2007/062469 A1 discloses an engine comprising a housing, a rotor having a driven shaft fastened thereon, which is mounted on the bearings spaced coaxially apart in the opposite sides of the housing and rotates about its axis of rotation and has a pair radially opposite cylinders spaced in the body of the rotor eccentrically and equidistantly relative to its axis of rotation. One radially outer end of each cylinder is closed by the wall and the other end is closed by piston which slides within the cylinder. Gas intake and gas exhaust may take place through the ducts in the body of the rotor extending from the cylinders to the inner pipe port of the driven shaft. There is a rotary ring mounted on the bearings spaced coaxially apart in the opposite sides of the housing. It rotates about its axis of rotation spaced apart from the rotor axis by an eccentricity and being impelled to rotate in the same direction and with the same velocity relative to the rotor by pins of the rotor. The pistons are connected to the rotary ring through the connecting rods.

RU 2 088 762 C1 discloses a piston rotary engine comprising a housing, a rotor rigidly connected to an output shaft, supporting rollers installed in housing borings, and a rotating ring eccentric to the rotor.

DE 37 30 558 A1 discloses an internal combustion rotary engine with lifting engagement having a cylinder unit of at least one cylinder, in which the drive shaft encloses the cylinder unit which is mounted eccentrically to it. Both rotate in a closed housing in the same direction and in a rotational ratio of 1:1, the rotational movement of the drive shaft being transmitted to the cylinder unit by gear wheels or lever mechanisms. The piston located in the cylinder is pivotally mounted on the drive shaft by a connecting rod. Air, fuel and exhaust gas are transported by the hollow shaft located in the center of the cylinder unit. When rotating, the centers of the hollow shaft, cylinder unit, piston pin and connecting rod bearing of the drive shaft form a straight line at top dead center and bottom dead center.

U.S. Pat. Nos. 988 938 A discloses a rotary engine comprising a primary member including a plurality of fluid pressure operated pistons and piston rods pivotally connected at their inner ends to the pistons, a shaft extending through the primary member and projecting from each side thereof, bearings for the projecting ends of said shaft, an annular member surrounding the primary member and having its axis parallel to and off-set with respect to the axis of the primary member and further having the outer ends of the piston rods pivotally-connected thereto, links having their ends connected respectively to and overlapping said members and independent of the piston rods and disposed for securing the rotation of the annular member synchronously with the primary member on a fixed axis, and friction reducing devices bearing against opposite sides of the annular member and so disposed as to prevent the rotation of the axis of the annular member about the axis of the primary member and further confining the annular member in the plane of the thrust of the pistons in two directions at right angles to the longitudinal direction of the links.

OBJECTS AND SUMMARY OF THE INVENTION

It would be desirable to provide an improved rotary engines especially suited for electrical power generation in thermal power plants, geothermal plants as well as nuclear power plants that is simple, inexpensive, and durable, while being driven by various heat sources. Such a rotary engine may also be used in pumps and compressors.

The present invention solves this problem. According to the present invention, a rotary engine is provided comprising a stator, a first rotor rotatably mounted on the stator about a rotational axis of the first rotor, and a second rotor rotatably mounted on the stator about a rotational axis of the second rotor parallel to the rotational axis of the first rotor such that the second rotor is eccentrically mounted to and surrounding the first rotor, wherein the first rotor comprises a first cylinder with a piston chamber limited by a translationally displaceable first piston with a first rod fixed to an outer side of the second rotor on an end of the first rod outwardly projecting from the first cylinder towards the outer side of the second rotor and fixed to the first piston on the other end of the first rod. The first rotor further comprises at least one second cylinder, each of the at least one second cylinder comprising a piston chamber limited by a translationally displaceable second piston with a second rod coupled to an outer side of the second rotor on an end of the corresponding second rod outwardly projecting from the respective second cylinder towards the outer side of the second rotor and fixed to the corresponding second piston on the other end of the corresponding second rod. While the first rod of the first cylinder is fixed to the outer side of the second rotor, the second rods of the corresponding second cylinders require a particular amount of rotational movement within the second rotor to maintain operation of the rotary engine. The end of each second rod coupled to the outer side of the second rotor is supported such that the end is rotationally displaceable along a limited curved guide path within the second rotor.

In preferred embodiments of the invention, the first and the at least one second cylinders are radially arranged around the rotational axis of the first rotor.

In preferred embodiments of the invention, the first and the at least one second cylinders are radially arranged around the rotational axis of the first rotor in an equiangular distribution.

In preferred embodiments of the invention, the rotary engine further comprises at least one rail guide mounted on the outer side of the second rotor, each of the at least one rail guide providing the curved guide path to the respective second rod.

In preferred embodiments of the invention, each of the at least one rail guide comprises a curvilinear rail, and wherein the respective second rod is coupled to the corresponding curvilinear rail by rolling bearings.

In preferred embodiments of the invention, the first cylinder is configured to perform a limited translational movement along the first rod upon exerting or releasing pressure on the first piston, thereby causing the first rod to rotate about the rotational axis of the first rotor.

In preferred embodiments of the invention, each of the at least one second cylinder is configured to perform a limited translational movement along the corresponding second rod upon exerting or releasing pressure on the second piston of the respective second cylinder, thereby causing the corresponding second rod to perform a limited rotational movement.

In preferred embodiments of the invention, the limited rotational movement is performed about an instantaneous center of rotation defined by a translational movement of the corresponding second rod relative to the first rotor and a rotational movement of the first rotor about its rotational axis, wherein the translational movement of each second rod is caused by coupling the respective second rod to the outer side of the second rotor.

In preferred embodiments of the invention, the rotary engine further comprises linear-motion bearings along which at least one of the first and second rods glides into the corresponding cylinder.

In preferred embodiments of the invention, exerting pressure on a piston of a corresponding cylinder comprises injecting or releasing a fluid into the piston chamber of the corresponding cylinder, and wherein the corresponding cylinder is a pneumatic cylinder.

In preferred embodiments of the invention, the rotary engine is configured such that a fluid is injected into one of the first and the at least one second cylinders when the corresponding piston passes a top dead center in which the piston chamber of the respective cylinder has the smallest volume.

In preferred embodiments of the invention, the rotary engine is configured such that the fluid is released from one of the first and the at least one second cylinders when the corresponding piston passes a bottom dead center in which the piston chamber of the respective cylinder has the largest volume.

In preferred embodiments of the invention, the rotary engine is configured such that the fluid provided in a constant flow causes a constant rotation of the first rotor around its rotational axis.

In some embodiments, the rotary engine further comprises a rotor shaft with a rotational axis that coincides with the rotational axis of the first rotor.

In some embodiments, the rotational axis of the first rotor is a center axis of the first rotor.

In some embodiments, the rotational axis of the second rotor is a center axis of the second rotor.

In some embodiments, the rotary engine further comprises a pneumatic distribution unit connected to the first rotor and configured to distribute the compressed fluid to the first and the at least one second pneumatic cylinders.

In some embodiments, the rolling bearings comprise at least two radial ball bearing rollers arranged on opposite sides of the corresponding curvilinear rail.

In preferred embodiments of the invention, the fluid is a compressed gas.

In preferred embodiments, the fluid is compressed air or steam.

In preferred embodiments, the at least one second cylinder comprises two cylinders.

In a preferred embodiment, the first and the two second cylinders are radially arranged around the rotational axis of the first rotor in an equiangular distribution of 120°, wherein the end of each second rod coupled to the outer side of the second rotor is supported such that the end is rotationally displaceable along a limited curved guide path within the second rotor.

Some embodiments have exactly n second cylinders which are preferably arranged in an equiangular distribution of 360°/(n+1) around the rotational axis of the first rotor.

BRIEF DESCRIPTION OF THE DRAWINGS

Further features, objects and advantages of the invention will become apparent from the following detailed description taken in conjunction with the accompanying schematic drawings, in which.

DIMENSIONING OF THE ROTARY ENGINE

Figure 1:
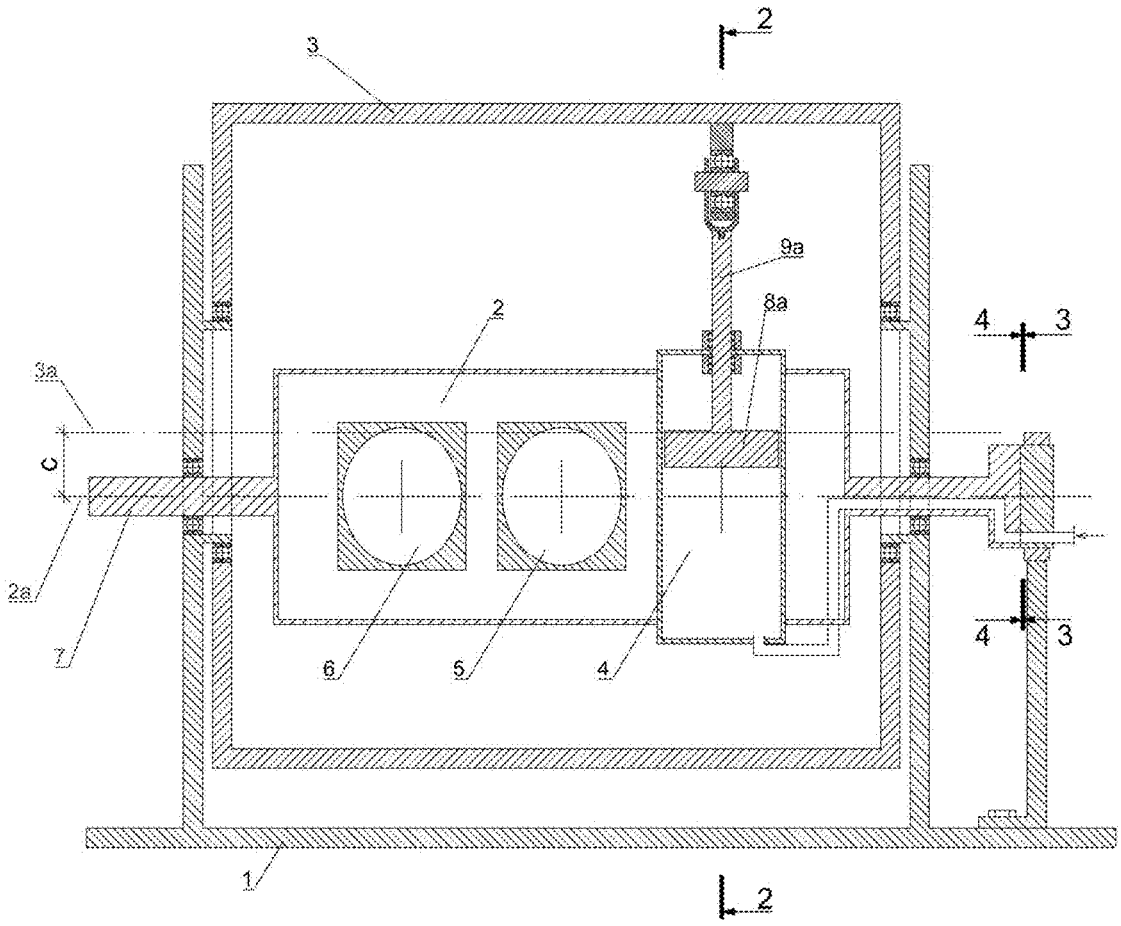
FIG. 1 shows a cross-sectional view 1-1 of a rotary engine according to an embodiment of the invention.

The dimensioning of the rotary engine requires knowledge about the longitudinal and the rotational piston travel of each of the cylinders upon rotation of the second rotor around the first rotor.

The following input parameters are given:

| | |
|---|---|
| A | denotes the rotational axis 2a of the first rotor 2; |
| B | denotes the rotational axis 3a of second rotor 3; |
| $C_n(\varphi)$ | denotes the current position of the piston axis of the respective piston 8n projected to the outer side of the second rotor 3a depending on the rotational angle $\varphi$ of the second rotor 3 about its rotational axis 3a; |
| a | denotes a radius of the second rotor 3a around its rotational axis 2a which is equivalent to the distance BC; |
| c | denotes the eccentricity of the rotational axis 3a relative to the rotational axis 2a which is equivalent to the distance AB; and |
| $\varphi$ | denotes the rotational angle of the second rotor 3 about its |

-continued

| |
|---|
| rotational axis 3a. |

The following output parameters may be calculated based on the given input parameters:

| | |
|---|---|
| $b_n(\varphi)$ | denotes the longitudinal piston travel of the respective piston 8n depending on the rotational angle φ which is equivalent to the distance AC, wherein:<br>$b_1$ denotes the piston travel of piston 8a fixed to second rotor 3,<br>$b_2$ denotes the piston travel of piston 8b whose carriage 14 moves along its corresponding rail guide 13, and<br>$b_3$ denotes the piston travel of piston 8c whose carriage 14 moves along its corresponding rail guide 13; |
| $x_n(\varphi)$ | denotes the rotational movement of the respective piston 8n which refers to the path of the carriage 14 of the respective piston 8n along the curved guide path that is projected to the outer side of the second rotor 3; |
| α | denotes the angle ∠BAC; |
| β | denotes the angle ∠ABC; and |
| γ | denotes the angle ∠ACB. |

The points ABC span a triangle with sides a, $b_n(\varphi)$, c and angles α, β, γ.

Trigonometric relationships are utilized to dimension the rotary engine, in particular the path of the first piston 8*a* and the second pistons 8*b*, 8*c*. The path of each piston 8*a*, 8*b*, 8*c* comprises a longitudinal component of piston travel, which is the only component for the first piston 8*a*, and of a rotational component of piston travel for the second pistons 8*b*, 8*c*.

Longitudinal Piston Travel $b_1(w)$ of Piston 8*a*

The movement of piston 8*a* is limited to a longitudinal change of the piston position due to its fixed connection to the outer side of the second rotor 3. The calculation of the longitudinal piston travel $b_1$ of piston 8*a* applies to a setup of the rotary engine without any second cylinder as well as to a setup with any number of second cylinders.

Figure 6A:
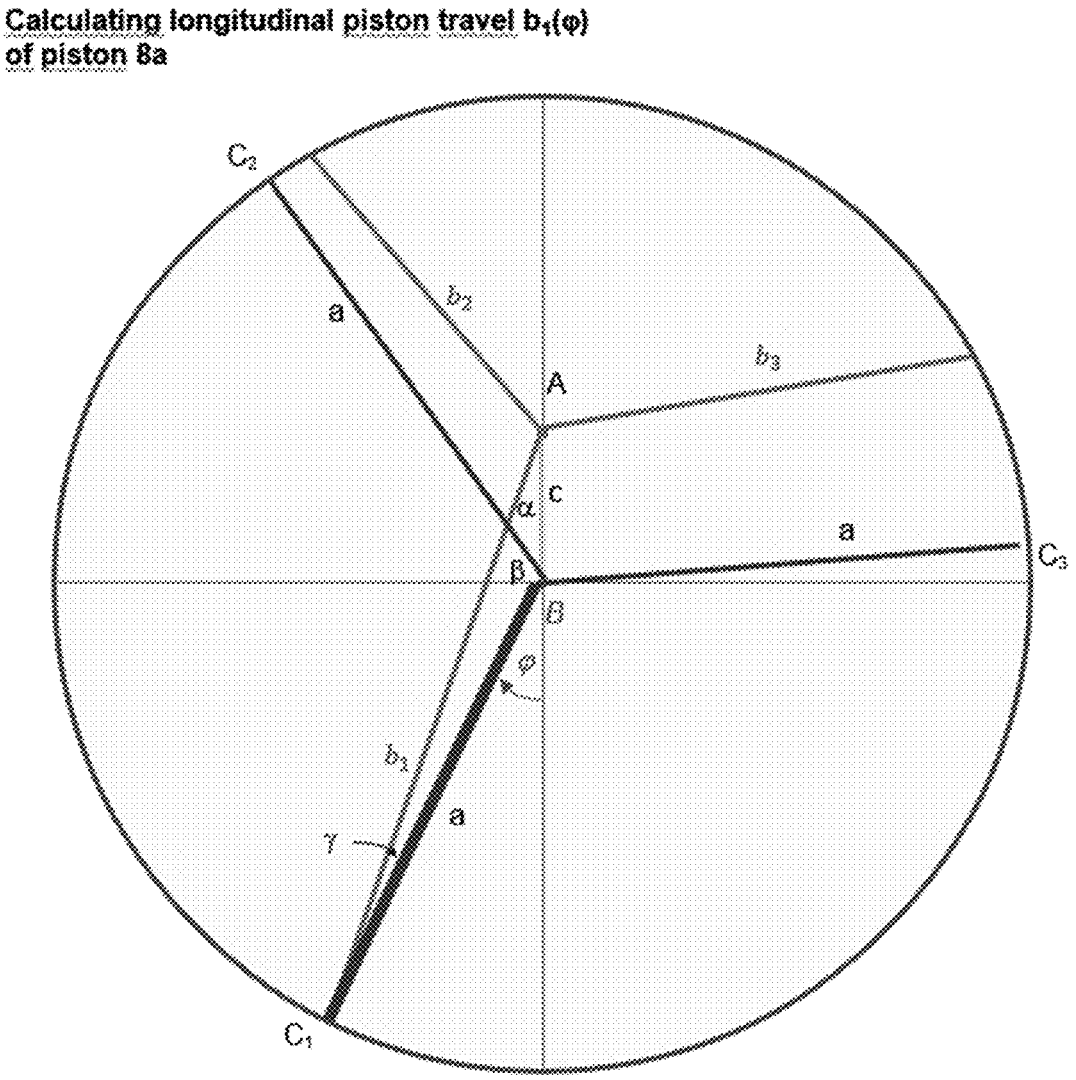
FIG. 6A shows a geometrical illustration for the calculation of longitudinal piston travel $b_1(\varphi)$.

FIG. 6A shows the geometrical illustration for the calculation of longitudinal piston travel $b_1(\varphi)$. For the calculation of $b_1$ we use the triangle spanned by the sides a, $b_1$, c with angle α being opposite to side a and angle β opposite to side $b_1$.

Angle β depends on the quadrant in which piston 8*a* is currently located:

β=180°−φ, with piston 8*a* in the $1^{st}$ or $2^{nd}$ quadrant,

β=φ−180°, with piston 8*a* in the $3^{rd}$ or $4^{th}$ quadrant.

$b_1$ is the side of the triangle opposite angle β and connecting a with c. The Law of Cosines leads to:

$$b_1^2=a^2+c^2-2ac\cos\beta=a^2+c^2-2ac\cos(180°-\varphi),$$

which results in the piston travel $b_1$ of piston 8*a* depending on the rotational angle φ:

$$b_1^2=a^2+c^2+2ac\cos(\varphi)$$

Due to the calculation of $b_1$ and β, the remaining angles α and γ may be determined. These angles depend on β.

α is the angle between triangle sides $b_1$ and c. The Law of Sines leads to:

$$\frac{a}{\sin\alpha}=\frac{b_1}{\sin\beta}$$

Solving this equation by inserting β and $b_1$ leads to:

$$(\sin\alpha)^2=\frac{a^2(\sin\beta)^2}{a^2+c^2-2ac\cos\beta}$$

As $\dot{\alpha}$ and $\dot{\beta}$ is not constant, the motion is an accelerated rotation, i.e. not uniform.

α depends on the quadrant in which piston 8*a* is currently located:

$$\alpha=\arcsin\left(\frac{a*\sin\beta}{b_1}\right),\text{ with piston }8a\text{ in the }1^{st}\text{ or }4^{th}\text{ quadrant,}$$

$$\alpha=180°-\arcsin\left(\frac{a*\sin\beta}{b_1}\right),\text{ with piston }8a\text{ in the }2^{nd}\text{ or }3^{rd}\text{ quadrant.}$$

γ is the angle between triangle sides a and $b_1$:

γ=180°−α−β

Longitudinal Piston Travel $b_2(Q)$ of Piston 8*b*

The calculation of the longitudinal piston travel of the second piston 8*b* is based on a geometry with three pistons 8*a*, 8*b*, 8*c* radially arranged around the rotational axis 2*a* of the first rotor 2 in an equiangular distribution of 120° each. The present invention is not limited to an equiangular distribution, the geometry may be adopted to any other angular distribution and amount pistons. Pistons 8*b* and 8*c* are placed with their end moving along a corresponding rail guide 13 connected to the outer side of the second rotor 3. This rotational motion also changes the piston travel.

Figure 6B:
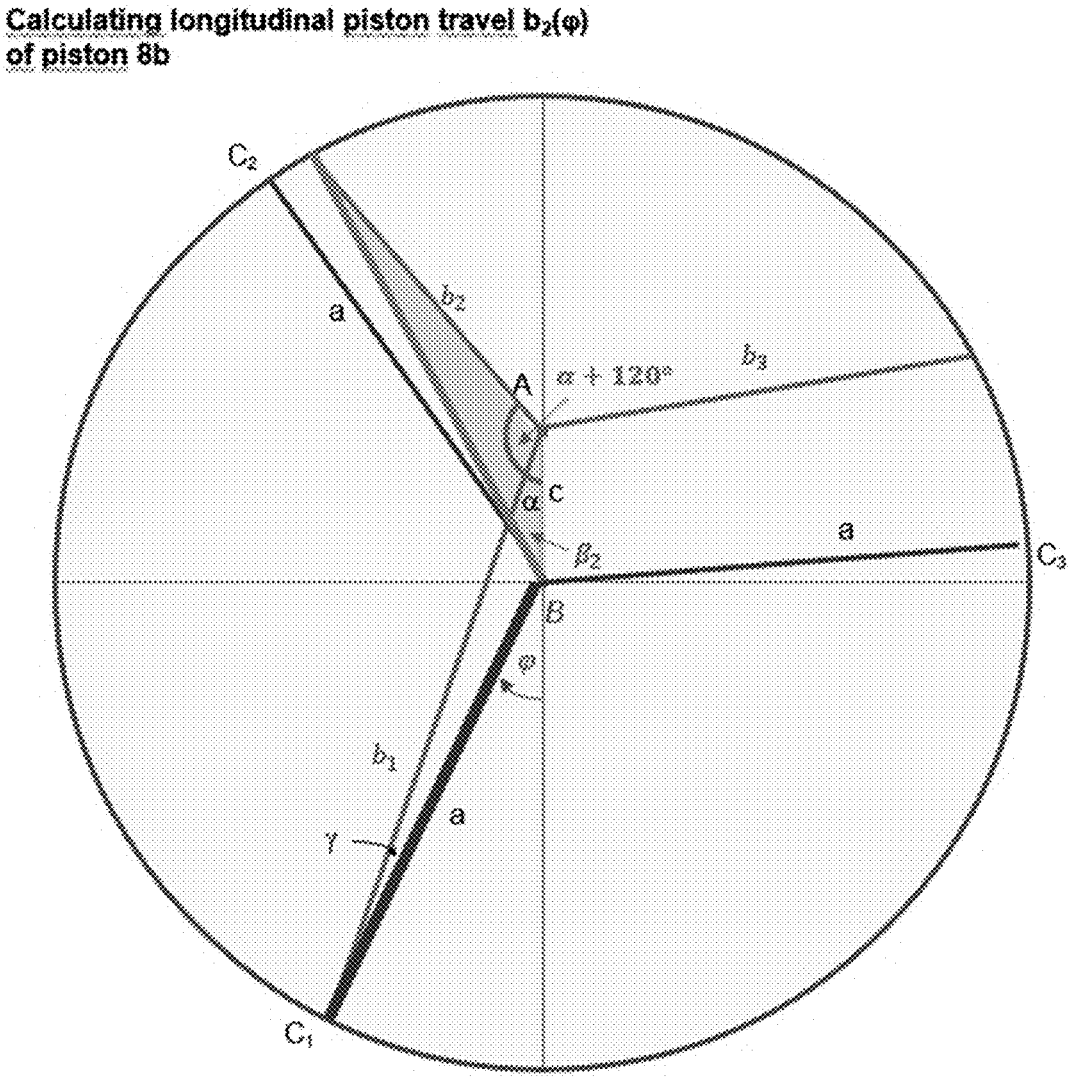
FIG. 6B shows a geometrical illustration for the calculation of longitudinal piston travel $b_2(\varphi)$.

FIG. 6B shows the geometrical illustration for the calculation of longitudinal piston travel $b_2(\varphi)$. $C_2$ is located at the outer side of the rotor 3 and represents the center point of the movement along the respective curved guide path in its projection onto the outer side of the second rotor 3.

For the calculation of $b_2$, we use the triangle spanned by sides a, $b_2$, c with angle α(φ)+120° being opposite to side a and angle $\beta_2$ opposite to side $b_2$.

The addition of 120° is due to the setup of using three pistons arranged in an equiangular distribution. In general, the above calculation may also be performed for a setup with more or less than three pistons. In this case, the value of 120° for 3 pistons needs to be replaced by 360°/n with n being the amount of pistons in an equiangular distribution. If the distribution is not equiangular, the calculation needs to be performed for each single angular offset to the next piston which needs to be added to α(φ).

The current angle α is calculated as shown above with respect to the longitudinal piston travel $b_1$. α depends on the current rotation angle φ.

a is the side of the triangle opposite angle α(φ)+120° and connecting $b_2$ with c. The Law of Cosines leads to:

$$a^2=b_2^2+c^2-2b_2c\cos(\alpha+120°),\text{ for }\alpha\in[0°,<120°]$$

$$a^2=b_2^2+c^2-2b_2c\cos(\alpha-120°),\text{ for }\alpha\in[120°,<360°]$$

These equations are quadratic in $b_2$:

$$b_2^2-b_2*2c\cos(\alpha+120°)+c^2-a^2=0(8a)\text{ for }\alpha\in[0°,<120°]$$

$$b_2^2-b_2*2c\cos(\alpha-120°)+c^2-a^2=0(8b)\text{ for }\alpha\in[120°,<360°]$$

with the solution:

$$x_{1,2} = -\frac{p}{2} \pm \sqrt{\left(\frac{p}{2}\right)^2 - q} \cdot,$$

wherein:

$$x^2+px+q=0,$$

$$p=-2c\cos(\alpha+120°), \text{ for } \alpha\in[0°,<120°],$$

$$p=-2c\cos(\alpha-120°), \text{ for } \alpha\in[120°,<360°], \text{ and}$$

$$q=c^2-a^2.$$

Calculation of Rotational Piston Travel x of Piston 8*b*

The distance x that is traveled by the carriage 14 connected to piston 8*b* via rod 9*b* along the rail guide 13 depends on the angle δ which is the angle between the zero-position (center position) at the rail guide, which is given at the intersection of radius a of second rotor 3 and the position of the carriage 14 at the rail guide 13 projected to the outer side of second rotor 3 at point $C_2$.

Figure 6C:
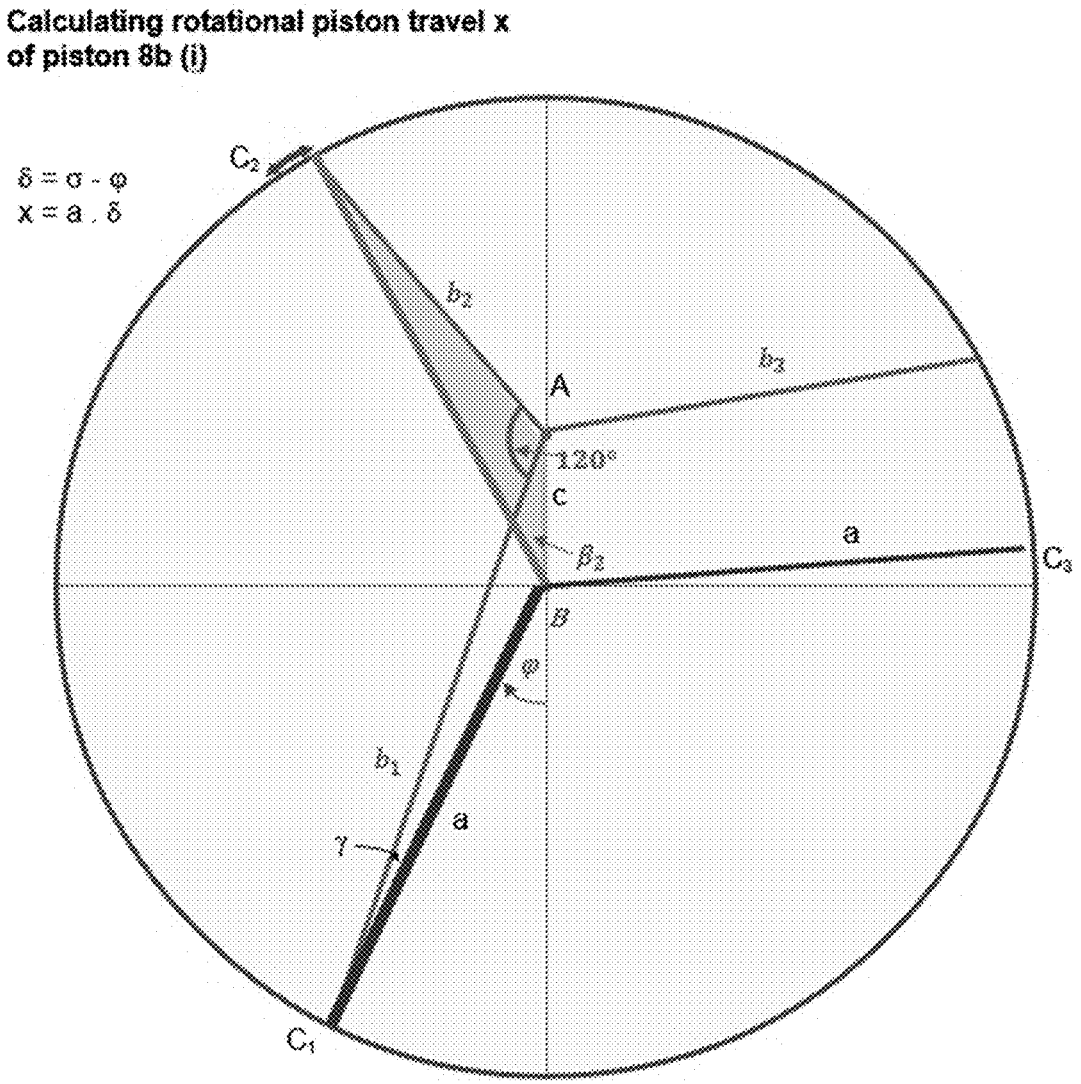
FIG. 6C shows a geometrical illustration for the calculation of rotational piston travel x along the rail guide (triangle setup for trigonometric calculations)
Figure 6D:
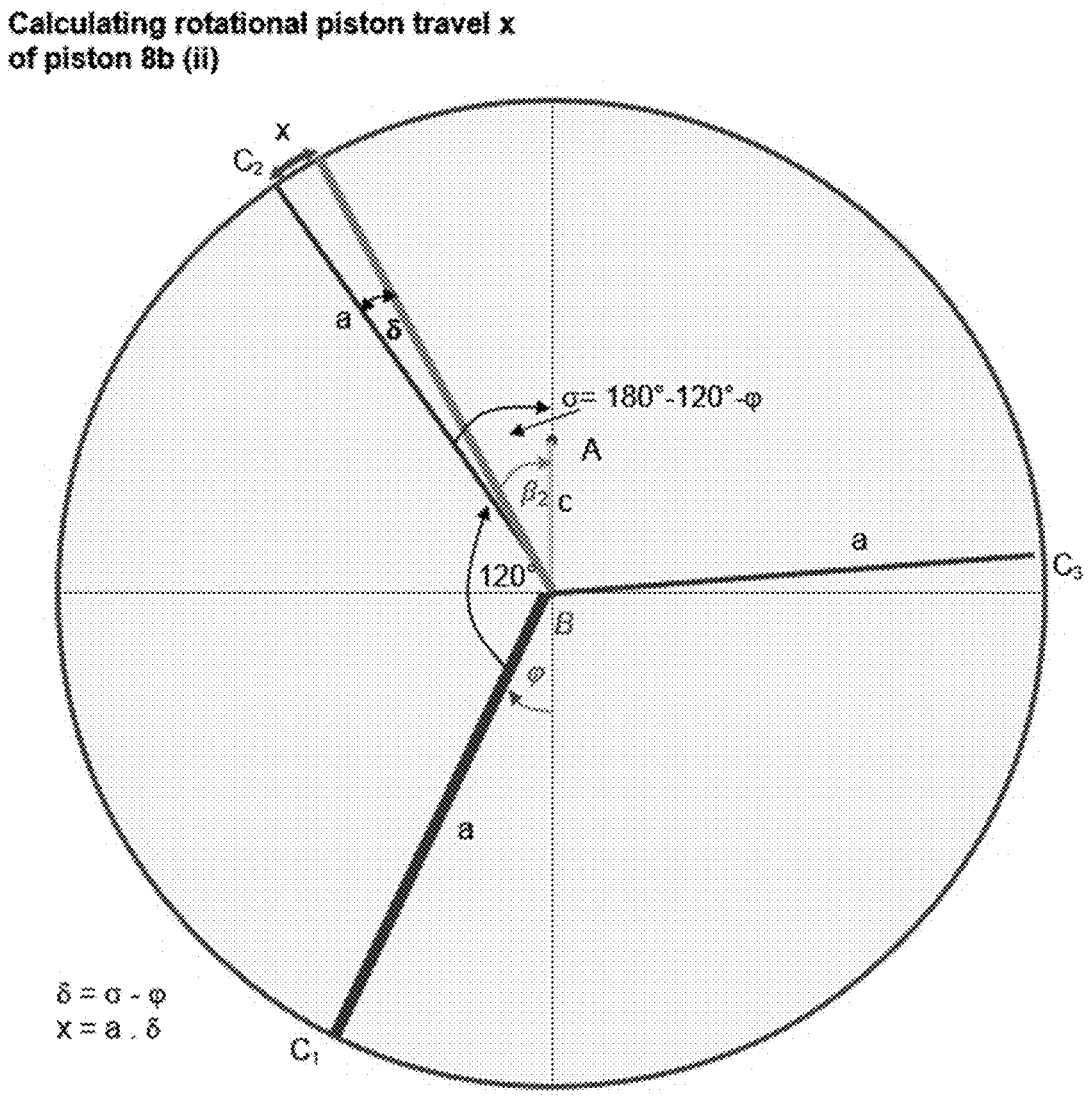
FIG. 6D shows a further geometrical illustration for the calculation of rotational piston travel x along the rail guide (triangle setup for trigonometric calculations).

FIG. 6C and FIG. 6D show the geometrical illustrations for the calculation of rotational piston travel x along the rail guide (triangle setup for trigonometric calculations). The positional changes x of the second piston 8*b* projected to the outer side of the second rotor 3 can be derived from a triangle spanned by the sides a, $b_2$, c with angle $\alpha(\varphi)+120°$ being opposite to side a and angle $\beta_2$ opposite to side $b_2$. However, further angular dependencies need to be considered as shown in illustration 4.

The rotational piston travel x projected to the outer side of the second rotor 3 depends on the rotation of piston 8*b* about an angle S that in turn depends on the rotational angle φ. In a rotary engine with three pistons 8*a*, 8*b*, 8*c* in an equiangular distribution, $\sigma=180°-120°-\varphi$ and $\delta+\beta_2=\sigma$ leads to:

$$\delta_{max}=\max\ \delta(\varphi)$$

$$x=a\cdot\delta_{max}$$

DETAILED DESCRIPTION OF EXEMPLARY EMBODIMENTS OF THE INVENTION

FIG. 1 shows a rotary engine according to an embodiment of the present invention in cross-sectional view 1-1. The rotary engine comprises a stator 1, a first rotor 2 rotatably mounted on the stator 1 about a rotational axis 2*a* of the first rotor 2, and a second rotor 3 rotatably mounted on the stator 1 about a rotational axis 3*a* of the second rotor 3 parallel to the rotational axis of the first rotor 2 such that the second rotor 3 is eccentrically mounted with distance c to the first rotor 2. The first rotor 2 is surrounded by the second rotor 3.

The first rotor 2 comprises a first cylinder 4 with a piston chamber limited by a translationally displaceable first piston 8*a* with a first rod 9*a* fixed to an outer side of the second rotor 3 on an end of the first rod 9*a* outwardly projecting from the first cylinder 4 towards the outer side of the second rotor 3 and fixed to the first piston 8*a* on the other end of the first rod 9*a*.

The first rotor 2 further comprises two second cylinders 5, 6. Each of the second cylinders 5, 6 comprises a piston chamber limited by a translationally displaceable second piston 8*b*, 8*c* with a second rod 9*b*, 9*c* coupled to an outer side of the second rotor 3 on an end of the corresponding second rod 9*b*, 9*c* outwardly projecting from the respective second cylinder 5, 6 towards the outer side of the second rotor 3 and fixed to the corresponding second piston 8*b*, 8*c* on the other end of the corresponding second rod 9*b*, 9*c*.

The first and second cylinders 4, 5, 6 are radially arranged around the rotational axis 2*a* of the first rotor 2 in an equiangular distribution resulting in an angular offset of 120° between each cylinder.

The end of each second rod 9*b*, 9*c* coupled to the outer side of the second rotor 3 is supported such that the end is rotationally displaceable along a limited curved guide path within the second rotor 3. The limited curved guide path is implemented by a rail guide 13 mounted on the outer side of the second rotor 3, located at the interior side of the second rotor 3. The rail guide 13 may comprise a curvilinear rail. The respective second rod 9*b*, 9*c* is coupled to the corresponding curvilinear rail by rolling bearings 14.

A power take-off (PTO) shaft may be mounted on an end of the first rotational axis 2*a*.

Due to the eccentric arrangement of the first rotor 2 relative to the second rotor 3, the pistons 8*a*, 8*b*, 8*c* can perform work and move from an upper dead center to a lower dead center which will cause both the first rotor 2 and the second rotor 3 to rotate around their respective rotational axis 2*a*, 3*a* by 180°.

The rotary engine is operated by injecting compressed fluid into one of the first and second cylinders 4, 5, 6 when the corresponding piston 8*a*, 8*b*, 8*c* passes a top dead center in which the piston chamber of the respective cylinder 4, 5, 6 has the smallest volume. The compressed fluid is released from one of the first and second cylinders 4, 5, 6 when the corresponding piston 8*a*, 8*b*, 8*c* passes a bottom dead center in which the piston chamber of the respective cylinder 4, 5, 6 has the largest volume. The compressed fluid is provided in a constant flow to cause a constant rotation of the first rotor 2 around its rotational axis 2*a*.

Figure 2:
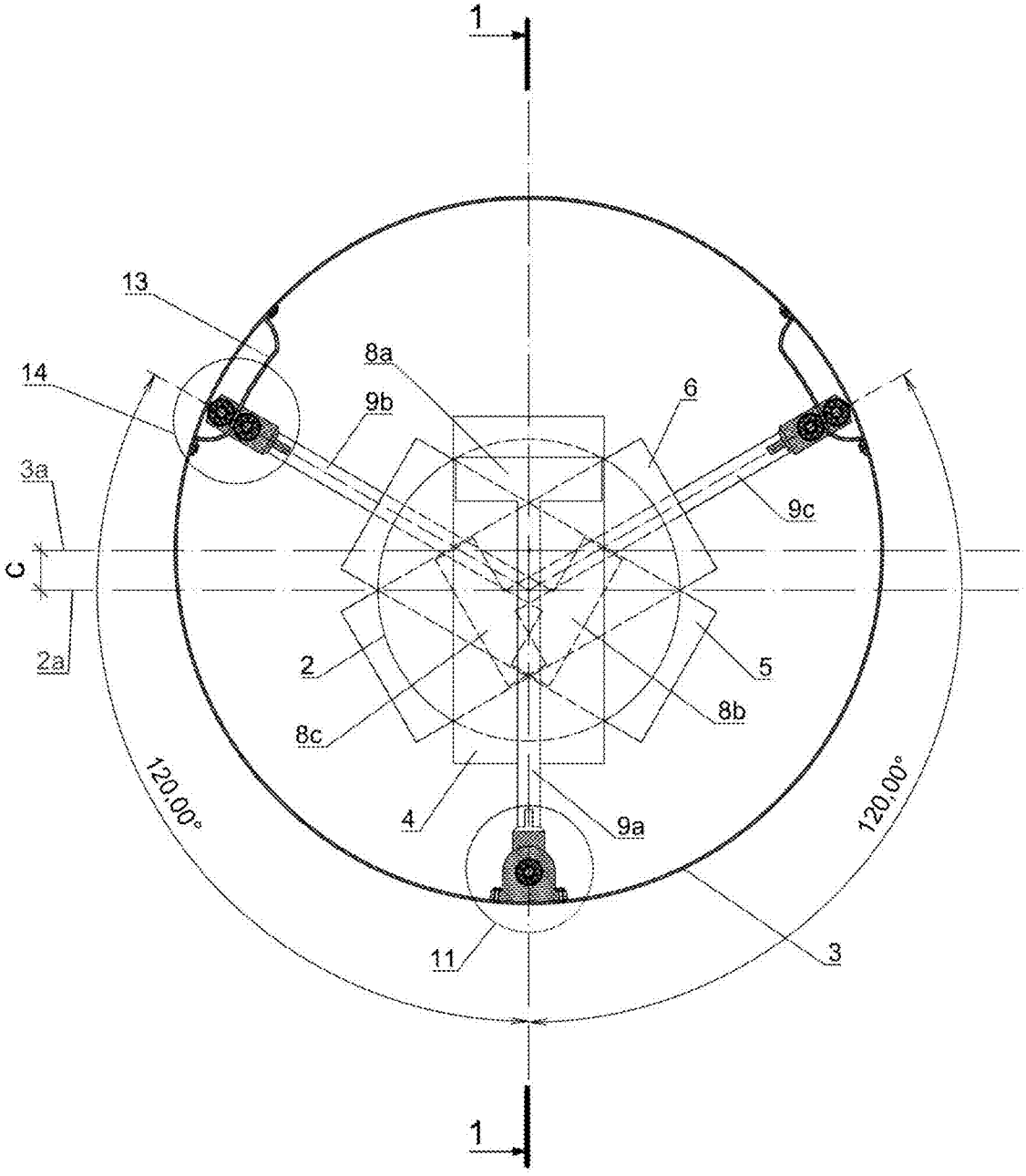
FIG. 2 shows a cross-sectional view 2-2 of a rotary engine according to an embodiment of the invention.

FIG. 2 shows the rotary engine of FIG. 1 in cross-sectional view 2-2. The eccentricity of the rotational axes 2*a*, 3*a* causes a rotational movement of the rods 9*b*, 9*c* along the rail guide 13 when operating the rotary engine.

Figure 3A:
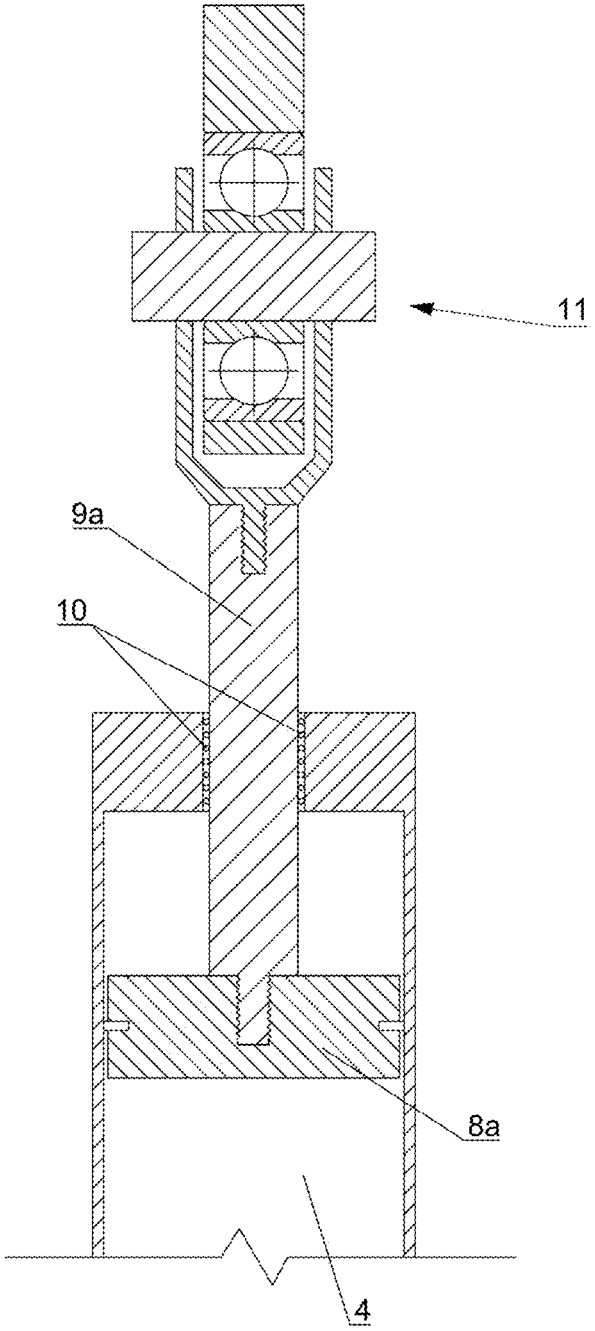
FIG. 3A shows a cross-sectional view 2-2 of a first rod fixed to an outer side of a second rotor according to an embodiment of the invention.

FIG. 3A shows a cross-sectional view 4-4 of a first rod 9*a* fixed to an outer side of a second rotor 3 by means of a bearing housing 11 to support lateral vibrations when operating the rotary engine. First rod 9*a* exits the first cylinder 4 along linear bearings 10 mounted in a rod hole in the cylinder head of the first cylinder 4.

Figure 3B:
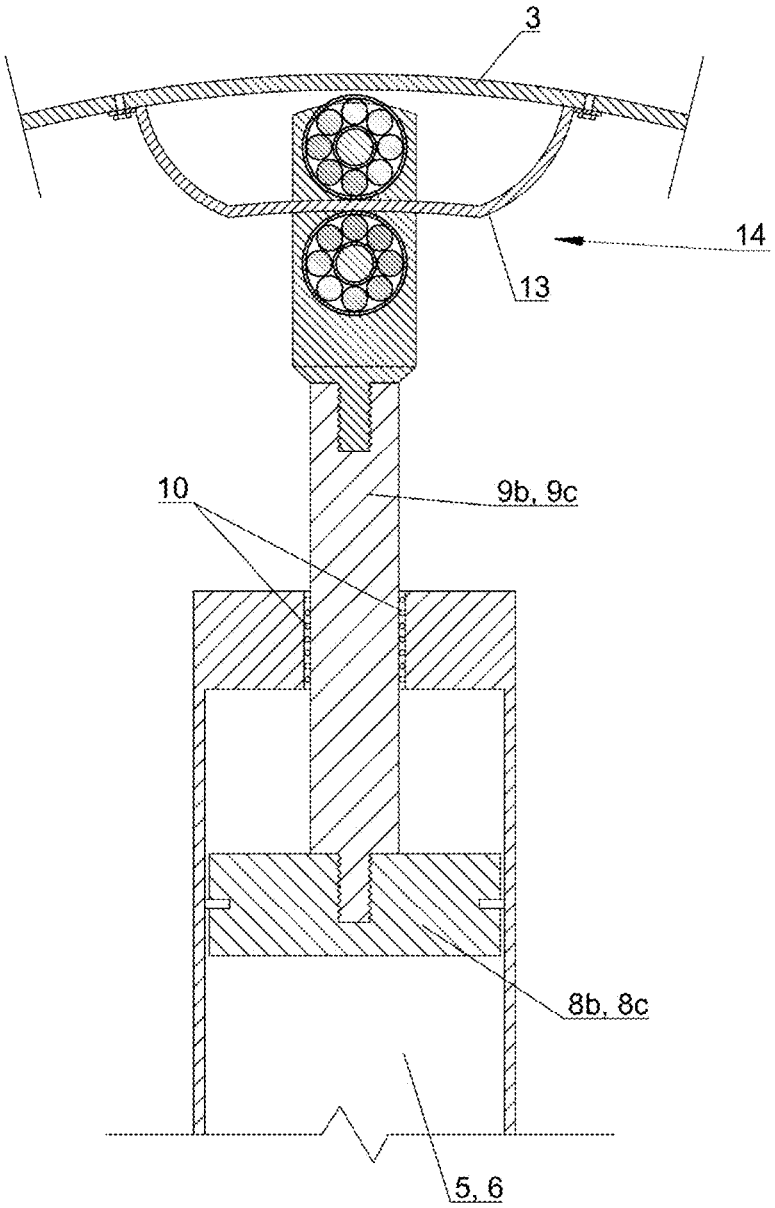
FIG. 3B shows a cross-sectional view 2-2 of a second rod coupled to an outer side of a second rotor according to an embodiment of the invention.

FIG. 3B shows a cross-sectional view 3-3 of a second rod 9*b*, 9*c* coupled to an outer side of a second rotor 3 by means of a rolling bearings 14 moving along a curvilinear rail of a rail guide 13. The rolling bearings 14 may be implemented as a carriage.

Figure 4A:
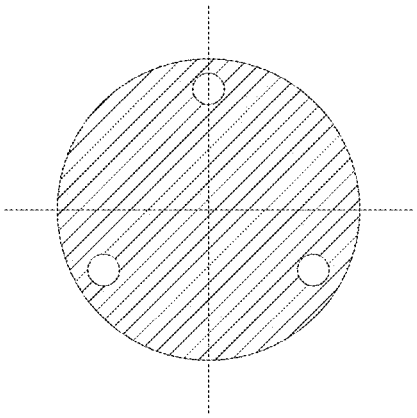
FIG. 4A shows a cross-sectional view 3-3 of a pneumatic distribution unit for a rotary engine according to an embodiment of the invention.
Figure 4B:
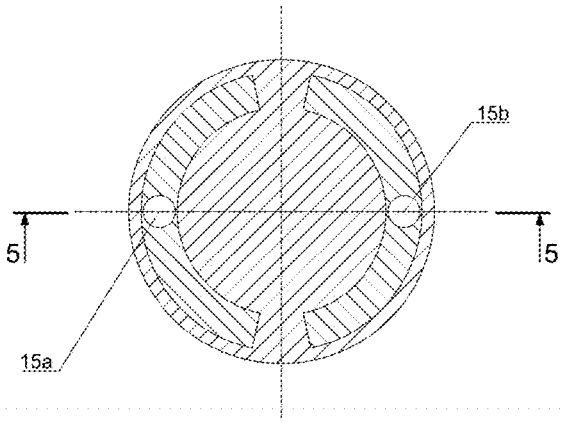
FIG. 4B shows a cross-sectional view 4-4 of a pneumatic distribution unit for a rotary engine according to an embodiment of the invention.
Figure 4C:
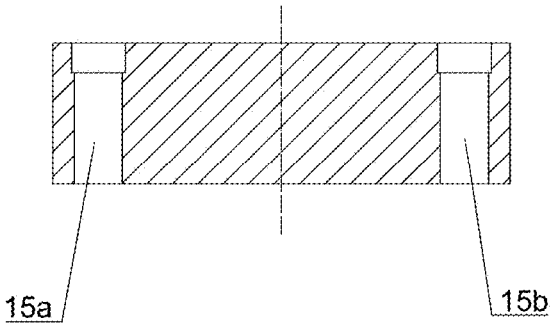
FIG. 4C shows a cross-sectional view 5-5 of a pneumatic distribution unit for a rotary engine according to an embodiment of the invention.

FIG. 4A-4C shows cross-sectional views 3-3, 4-4, and 5-5 of a pneumatic distribution unit for a rotary engine according to an embodiment of the invention. On an end of the first rotational axis 2*a*, for example opposite to the end where a PTO shaft is mounted, the pneumatic distribution unit may be mounted to distribute compressed fluid through fluid channels to the first and second cylinders 4, 5, 6 one by one at the right moment of engine rotation and to release exhaust fluid. Compressed fluid enters the working part of the respective cylinder 4, 5, 6. Therefore, pressure forces arise that put pressure on the corresponding piston 8*a*, 8*b*, 8*c* attached to its rod 9*a*, 9*b*, 9*c* which is coupled to the outer side of the second rotor 3.

Figure 5:
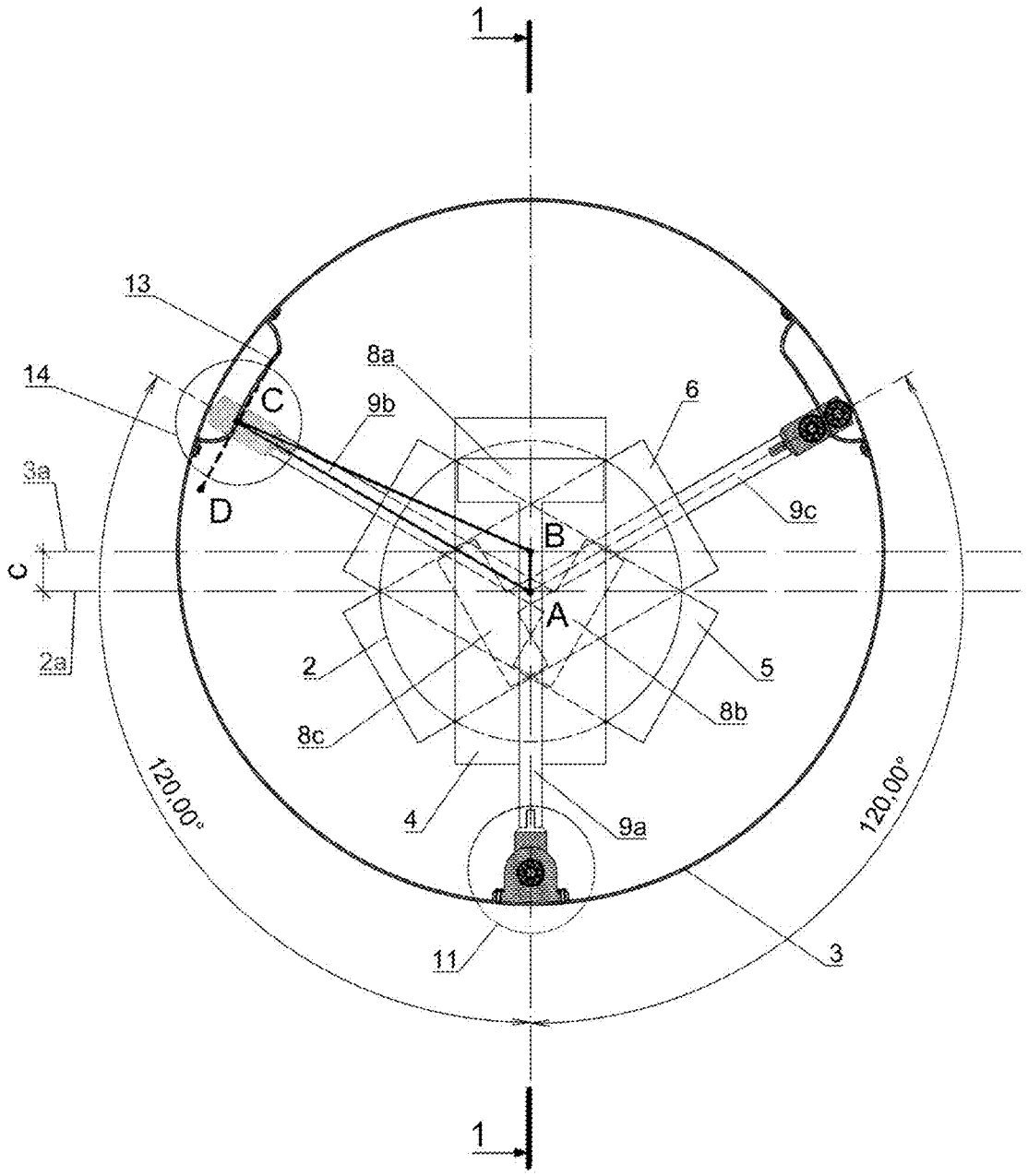
FIG. 5 shows across-sectional view 2-2 of a rotary engine according to an embodiment of the invention for dimensioning a rail guide.

FIG. 5 shows the geometry for calculating the required length of rail guide 13 to support rotational movement of the second pistons 8*b*, 8*c* of the second cylinders 5, 6 due to the eccentricity of the first rotor 2 and the second rotor 3. The second pistons 8*b*, 8*c* are connected to corresponding rods

9*b*, 9*c* on which a respective carriage 14 is mounted which is guided along a curved path of the rail guide 13.

Depending on the rotational position of second rotor 3 relative to first rotor 2, carriage 14 moves along the rail guide 13.

FIG. 5 depicts the position of the components of the rotary engine such that second rods 9*b*, 9*c* and their respective carriage 14 are located at the utmost position at the corresponding rail guide 13. The length of the curved path of rail guide 13 can be determined based on the angle between the longitudinal axis of carriage 14 and the tangent to the rail guide 13. Four points and distances in between are introduced in FIG. 5 in order to perform the required calculations, wherein:

the longitudinal axis of the rod 9*b*, 9*c* corresponding to the respective second pistons 8*b*, 8*c* are referred to as carriage axis;

A denotes the rotational axis 2*a* of the first rotor 2;

B denotes the rotational axis 3*a* of the second rotor 3;

C denotes the intersection point between the carriage axis of the respective rod 9*b*, 9*c* and the corresponding rail guide 13;

D denotes a point on the tangent to the rail guide 13 through point C;

AC represents the carriage axis and denotes the distance from the rotational axis 2*a* of the first rotor 2 to rail guide 13 at intersection point C;

AB denotes the eccentricity between the rotational axes 2*a*, 3*a* of the first rotor 2 and the second rotor 3;

BC denotes the distance from the rotational axis 3*a* of the second rotor 3 to the rail guide 13 at intersection point C; and CD denotes the tangent to the rail guide 13.

From the above definitions follows that angle ∠BCD is rectangular (90°) and that ∠ACD denotes the angle between CD, the tangent to the rail guide 13, and AC, the carriage axis, which represents the relevant angle to dimension the rail guide.

In order to determine ∠ACD, we need to calculate (i) the distance BC between the rotational axis 3*a* of the second rotor 3 and rail guide 13 at intersection point C, and (ii) ∠ACB between BC and AC around intersection point C. AC is given.

In order to calculate the distance BC between the rotational axis 3*a* of the second rotor 3 to the rail guide 13 at intersection point C, we use the Law of Cosines for an arbitrary triangle. In our case, this is the ABC triangle:

$$BC=\sqrt{AB^2+AC^2-2*AB*AC*\cos\angle BAC}$$

In order to calculate ∠ACB between BC and AC, we use the Law of Sines for an arbitrary triangle. In our case, this is the ABC triangle:

$$\frac{AB}{\sin\angle ACB}=\frac{BC}{\sin\angle BAC}\Rightarrow\sin\angle ACB=\frac{\sin\angle BAC\cdot AB}{BC}$$

$$\arcsin(\sin\angle ACB)=\angle ACB$$

In conclusion, we may determine ∠ACD as the angle between the tangent to the rail guide 13 and the longitudinal axis of the carriage 14 by subtracting the calculated from ∠ACB from ∠BCD which is 90°:

$$\angle ACD=\angle BCD-\angle ACB$$

The details contained in the above description of embodiments should not be construed as limiting the scope of the invention but rather represent an exemplification of some of its embodiments. Many variants are possible and immediately apparent to the skilled person. In particular, this relates to variations comprising a combination of features of the individual embodiments disclosed in the present specification. Therefore, the scope of the invention should be determined not by the illustrated embodiments, but by the appended claims and their legal equivalents.

The invention claimed is:

1. A rotary engine, comprising:

a stator;

a first rotor rotatably mounted on the stator about a rotational axis of the first rotor; and a second rotor rotatably mounted on the stator about a rotational axis of the second rotor parallel to the rotational axis of the first rotor such that the second rotor is eccentrically mounted to and surrounding the first rotor;

wherein the first rotor comprises a first cylinder with a piston chamber limited by a translationally displaceable first piston with a first rod fixed to an outer side of the second rotor on a first end of the first rod outwardly projecting from the first cylinder towards the outer side of the second rotor and fixed to the first piston on a second end of the first rod; and wherein the first rotor further comprises at least one second cylinder, each of the at least one second cylinder comprising a piston chamber limited by a translationally displaceable second piston with a second rod coupled to the outer side of the second rotor on a first end of the corresponding second rod outwardly projecting from the respective second cylinder towards the outer side of the second rotor and fixed to the corresponding second piston on a second end of the corresponding second rod;

characterized in that the end of each second rod coupled to the outer side of the second rotor is supported such that the end is rotationally displaceable along a limited curved guide path within the second rotor.

2. The rotary engine of claim 1, wherein the first and the at least one second cylinders are radially arranged around the rotational axis of the first rotor.

3. The rotary engine of claim 2, wherein the first and the at least one second cylinders are radially arranged around the rotational axis of the first rotor in an equiangular distribution.

4. The rotary engine of claim 1, wherein the at least one second cylinder comprises two cylinders.

5. The rotary engine of claim 1, further comprising:

at least one rail guide mounted on the outer side of the second rotor, each of the at least one rail guide providing the curved guide path to the respective second rod.

6. The rotary engine of claim 5, wherein each of the at least one rail guide comprises a curvilinear rail, and wherein the respective second rod is coupled to the corresponding curvilinear rail by rolling bearings.

7. The rotary engine of claim 1, wherein the first cylinder is configured to perform a limited translational movement along the first rod upon exerting or releasing pressure on the first piston, thereby causing the first rod to rotate about the rotational axis of the first rotor.

8. The rotary engine of claim 1, wherein each of the at least one second cylinder is configured to perform a limited translational movement along the corresponding second rod upon exerting or releasing pressure on the second piston of the respective second cylinder, thereby causing the corresponding second rod to perform a limited rotational movement.

9. The rotary engine of claim 8, wherein the limited rotational movement is performed about an instantaneous center of rotation defined by a translational movement of the corresponding second rod relative to the first rotor and a rotational movement of the first rotor about its rotational axis, wherein the translational movement of each second rod is caused by coupling the respective second rod to the outer side of the second rotor.

10. The rotary engine of claim 1, further comprising:

linear-motion bearings along which at least one of the first and second rods glides into the corresponding cylinder.

11. The rotary engine of claim 1, wherein exerting pressure on a piston of a corresponding cylinder comprises injecting or releasing compressed fluid into the piston chamber of the corresponding cylinder, and wherein the corresponding cylinder is a pneumatic cylinder.

12. The rotary engine of claim 11, wherein compressed fluid is injected into one of the first and the at least one second cylinders when the corresponding piston passes a top dead center in which the piston chamber of the respective cylinder has the smallest volume.

13. The rotary engine of claim 11, wherein the compressed fluid is released from one of the first and the at least one second cylinders when the corresponding piston passes a bottom dead center in which the piston chamber of the respective cylinder has the largest volume.

14. The rotary engine of claim 11, wherein the compressed fluid is provided in a constant flow to cause a constant rotation of the first rotor around its rotational axis.

15. The rotary engine of claim 11, wherein the compressed fluid is compressed air or steam.

* * * * *